United States Patent [19]

Montuoro et al.

[11] Patent Number: 5,004,305

[45] Date of Patent: Apr. 2, 1991

[54] REFRIGERATOR DOOR SHELVES

[75] Inventors: Lou D. Montuoro, Cedar Rapids; Toni L. Vandarakis, Iowa City; Richard L. Johnson, Cedar Rapids, all of Iowa

[73] Assignee: Amana Refrigeration Inc., Amana, Iowa

[21] Appl. No.: 534,220

[22] Filed: Jun. 7, 1990

[51] Int. Cl.[5] ..... A47B 81/00

[52] U.S. Cl. ..... 312/214; 312/350

[58] Field of Search ..... 312/321.5, 350, 214

[56] References Cited

U.S. PATENT DOCUMENTS

| | | | |
|---|---|---|---|
| 3,807,822 | 4/1974 | Amore | 312/321.5 |
| 4,921,315 | 5/1990 | Metcalfe et al. | 312/312.5 |
| 4,936,611 | 6/1990 | Bussan et al. | 312/350 X |

FOREIGN PATENT DOCUMENTS

| | | | |
|---|---|---|---|
| 2405385 | 5/1979 | France | 312/321.5 |
| 184242 | 6/1963 | Sweden | 312/321.5 |

*Primary Examiner*—Joseph Falk

*Attorney, Agent, or Firm*—William R. Clark; Richard M. Sharkansky

[57] ABSTRACT

A refrigerator door shelf arrangement wherein the door liner has opposing side panels with corresponding front to back slots or guide channels at a plurality of vertical positions. The slots are formed by a plurality of horizontal ribs, each of which has a laterally facing notch. Bucket shelves have lateral horizontal runners on the sides arranged to be received in sliding engagement in corresponding slots. Each side of a shelf has a flap that can bend inwardly. As the runners of the shelf are being inserted into corresponding slots, a ramp tab on each flap engages the rib above the runner thereby causing the flap to be bent away from the rib until the tab aligns with and enters the respective notch of the rib. Thus, in the fully inserted position, the shelf is securely mounted, and movement upward, downward, or frontward is prevented. Manual bending of the flaps away from the ribs permits the shelf to be removed for cleaning or to be mounted at an alternate vertical position.

10 Claims, 5 Drawing Sheets

REFRIGERATOR DOOR SHELVES

BACKGROUND OF THE INVENTION

The field of the invention generally relates to refrigerators, and more particularly relates to apparatus and method for attaching shelves to the door liner.

As is well known, refrigerators typically have shelves or buckets in the doors. Such shelves are popular because they generally increase the storage capacity of a refrigerator, and also there is convenient access to items stored in the door.

One prior art door shelf approach is to form a horizontal support surface in the door liner, and then affix a retainer bar across the front so that stored items such as bottles or milk cartons will not fall off the horizontal support surface. An advantage of this configuration is that it is relatively inexpensive to fabricate because the shelf support surface is formed when the liner is made by a vacuum form process. However, the height of such a shelf is not adjustable, and therefore the configurations of shelves is not versatile. That is, the owner cannot reconfigure the heights of various shelves to obtain an optimum arrangement for the food items that are typically stored. Further, such shelves typically will not contain spills because they don't have a water-tight bucket. Therefore, if milk or soft drinks are spilled, the liquid runs down over the entire door. Another disadvantage is that there are no serviceable parts. That is, if a portion of the support surface cracks or is broken, the entire liner must be replaced because there are not smaller integral parts that can be replaced.

Another door shelf approach is to use a door liner that has a vertical row of slots at each side, and provide a plurality of injection molded plastic bucket shelves each of which has hooks that insert into a respective pair of the slots. In an alternate embodiment of this approach, the slots can be formed in metal brackets that attach in front or behind the liner so as to provide increased strength. This general approach offers height adjustability, and also the bucket shelves has sealed bottoms that will contain spills. A further advantage is that the shelves can be removed for cleaning. However, with such shelves, the entire load of a shelf and its contents is carried by the hooks rather than being distributed over a relatively large area. Accordingly, relatively thick gauges of plastic must be used, and even then, the hooks are subject to breaking. Relatively thick material gauges are also required to minimize the flexing of the shelf. Also, consumers typically complain about the aesthetics because they don't like the rows of holes or slots in the liner. Another drawback of this approach is that if metal brackets and/or metal hooks are used so as to increase the strength, cost is greatly increased by the additional parts and labor to assemble them.

Still another door shelf approach is to use a door liner that has side panels or dikes with a structural geometry to support shelves. In one such arrangement, horizontal support slats or ledges are formed in the dikes, and ends of the shelf are seated or them. The support slats have upwardly extending bosses at the front to prevent a shelf from sliding forward. However, the shelf is not locked in place and is only maintained in position by gravity. Accordingly, when such a shelf is inadvertently bumped, it is easily knocked off the support slats and broken. Also, such a shelf does not contain spills. In another arrangement, short posts extend laterally inward from the opposing sides, and a shelf has corresponding recesses that are seated down onto respective posts. Because of the shape of the posts, they are independently fabricated and then attached to the vacuum formed liner. This fabrication process involves extra parts and additional labor. Also, the shelves are still supported by gravity, and therefore are subject to being inadvertently knocked off the posts. Further, because of liner dimension tolerances, these shelves are often difficult to insert and remove.

SUMMARY OF THE INVENTION

It is an object of the invention to provide an improved refrigerator shelf arrangement.

It is also an object to provide an improved refrigerator door shelf and method of attaching to the door liner wherein the vertical position of a shelf may easily be adjusted to provide a versatile and desirable configuration of shelves.

It is also an object to provide a refrigerator door shelf arrangement wherein reduced material gauges may be used to reduce costs while still providing shelf structure that is strong and durable.

It is an object to provide a refrigerator shelf arrangement wherein the shelves are locked in place so that they won't inadvertently be knocked off. That is, it is an object to provide a locking arrangement not solely dependent on gravity.

It is a further object to provide a refrigerator door shelf arrangement that has a desirable appearance and is unique.

It is an object to provide a refrigerator door shelf arrangement wherein spills are retained within a bucket shelf that is easily and readily removed and then replaced after cleaning.

It is a further object to provide a refrigerator door shelf arrangement that distributes the load over a relatively large surface area without adding extra brackets and other reinforcement parts.

In accordance with the invention, these and other objects are provided by refrigerator door apparatus comprising a door liner having opposing side panels, each comprising at least a pair of substantially horizontal ribs forming therebetween a guide channel wherein the respective guide channels on opposing side panels face each other. Also provided is a shelf comprising substantially horizontal side runners each adapted for being received in sliding engagement into a respective one of the guide channels wherein the shelf is substantially horizontally slidable to inward position in the guide channels where the shelf is supported by the liner. The shelf further comprises means for latching the shelf to the liner when the shelf is positioned at the inward position. It is preferable that the runners comprise means for providing an interference fit between the runners and the ribs. At least one of the ribs may preferably have a notch, and the latching means may preferably comprise a flexible finger or side flap having an outwardly extending tab wherein, as the shelf is being slideably inserted in one of the guide channels, the tab engages the one rib thereby flexing the finger inwardly until the tab aligns with the notch at which point the finger flexes back as the tab enters the notch to latch the shelf in the inward position. Preferably, each side panel comprises more than a pair of the ribs thereby forming a plurality of guide channels so that the shelf can be supported at alternate vertical positions. The shelf may also preferably comprise a bucket having a bottom, a back, a front, and sidewalls.

With such arrangement, an improved refrigerator door shelf arrangement is provided wherein shelves can easily be removed and replaced at various vertical positions so as to reconfigure the shelf arrangement within the refrigerator door. Also, the runners of the shelf are securely engaged between top and bottom ribs on the side panels so that the shelf cannot be inadvertently knocked from its supported position. Also, with the tabs being engaged within the rib notches in the inward position, a shelf is secured or latched from inadvertent removal. Also, the load on the shelf is distributed along the entire runners such that a durable configuration is provided without using relatively thick material gauges or additional metal supporting apparatus. Further, the bucket arrangement of the shelves contains spills, while the shelf may easily be removed for cleaning.

BRIEF DESCRIPTION OF THE DRAWINGS

The foregoing objects and advantages will be more fully understood by reading the description of the preferred embodiment with reference to the drawings wherein.

DESCRIPTION OF THE PREFERRED EMBODIMENTS

Figure 1:
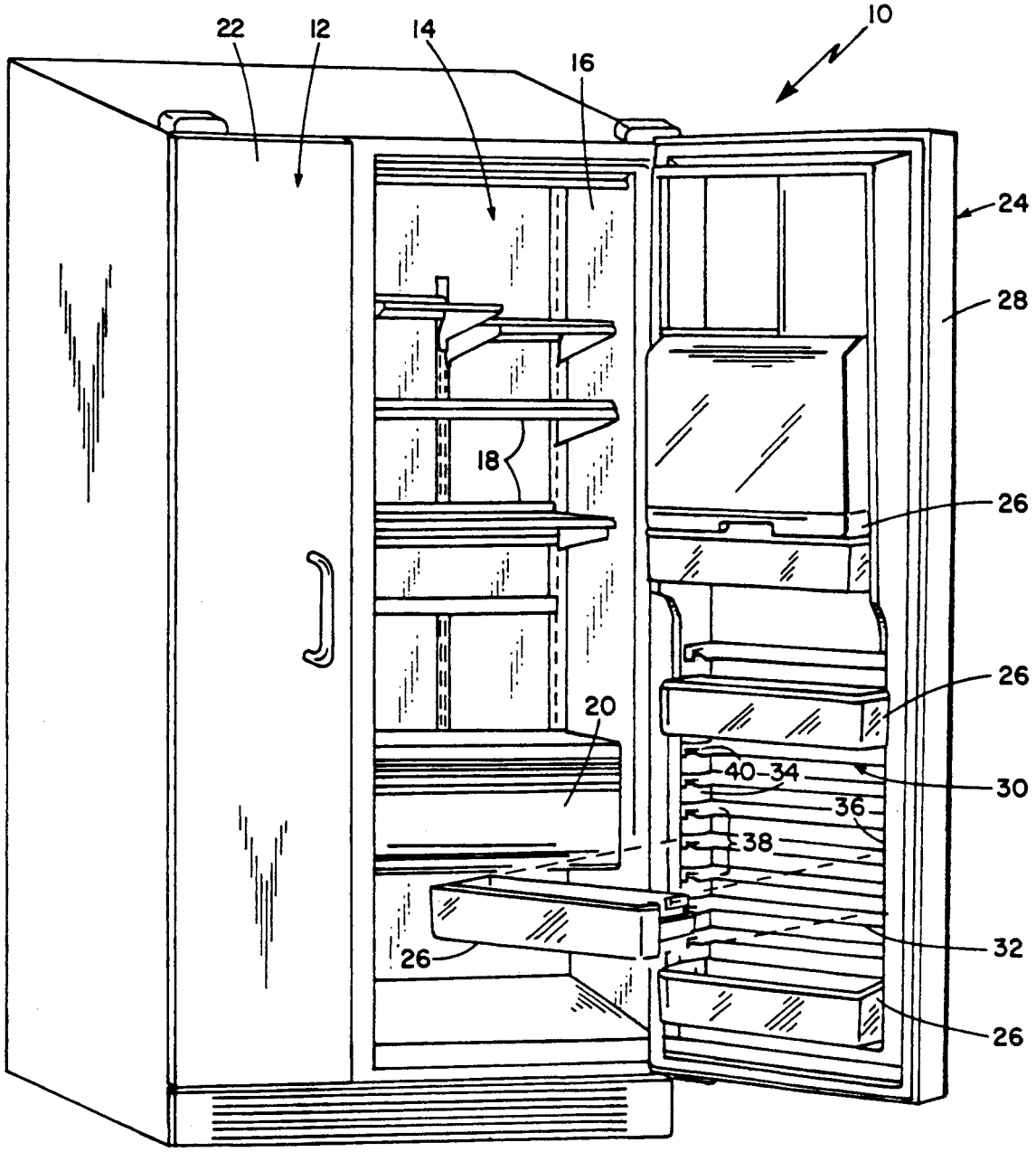
FIG. 1 is a front perspective view of a side-by-side refrigerator with one door open.

Referring generally to the drawings wherein like reference numerals refer to like parts throughout the several views, a refrigerator door liner 30 has opposing side panels 34 and 36 each of which has at least one and preferably more than one pair of substantially horizontal ribs 40 forming a guide channel 42 therebetween. The guide channels 42 face each other from opposing side panels 34 and 36 and are adapted for receiving respective side runners 64 of a shelf 26 in sliding engagement. As the shelf 26 is being slide inwardly, ramp tabs 84 on flexible flaps 80 engage the top rib 40 forcing the flap 80 to bend laterally until the shelf 26 reaches the fully inserted position. At this point, the ramp tabs 84 align with notches 50 in the top ribs, and the resilient flaps are permitted to flex outwardly as the ramp tabs 84 enter the respective notches 50 thereby latching the shelf 26 in the fully inserted position. A shelf 26 can easily be removed for cleaning or to alter its mounting position by pressing the flaps 80 inwardly so that the ramp tabs 84 are moved out of the respective notches 50.

FIG. 1 shows a perspective view of refrigerator 10. Although the invention could be used to advantage with other types of refrigerators such as so-called top mount or bottom mount refrigerators, here refrigerator 10 is a so-called side-by-side refrigerator having a freezer section 12 on one side and a refrigerated or fresh food section 14 on the opposite side. Refrigerated food section 14 includes a refrigerated food compartment 16 having conventional cantilever hung shelves 18 and a crisper compartment 20. Freezer section 12 has a freezer door 22, and refrigerated food section 14 has a refrigerated food door 24.

In accordance with the invention, doors 22 and 24 are provided with a new arrangement for attaching shelves 26 to doors 22 and 24. Doors 22 and 24 include an outer shell 28 or casing and an inner liner 30 with conventional insulation (not shown) disposed therebetween. Liner 30 is generally recessed in the center, and includes a back wall 32 and opposing side panels 34 and 36 that are commonly referred to as vertical dikes. Side panels 34 and 36 are generally parallel and face each other.

Figure 2:
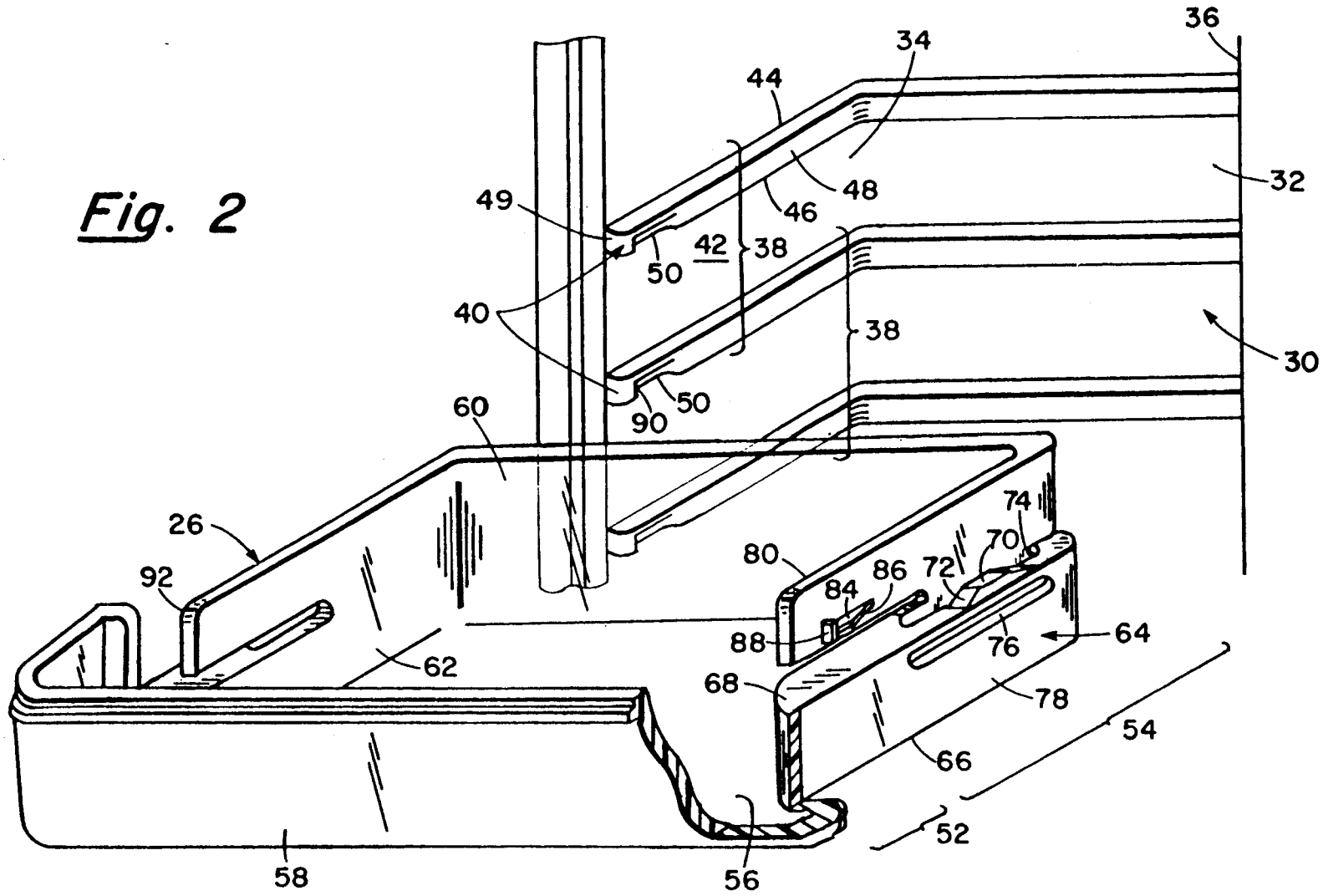
FIG. 2 is a perspective view of a bucket shelf aligned to be mounted in tracks of the door liner.

Also referring to FIG. 2, side panels 34 and 36 each have a plurality of tracks 38 that are positioned at different vertical positions or heights within door liner 30. Each track includes an upper and lower rib 40 that form a guide channel 42 or slot therebetween. In the preferred arrangement, the ribs 40 are equally spaced in the vertical direction such that the upper rib 40 for one track 38 will also serve as the lower rib 40 for the track 38 above. Each rib 40 has an upper surface 44, a lower surface 46, and an inward surface 48. As shown best in FIG. 2 and also in FIG. 5, the inward surface 48 of each rib 40 has a notch 50 or recess generally near the front of rib 40. For reasons to be described subsequently, it is preferable that each notch 50 be cut out from the lower portion of rib 40 such that the upper surface 44 is flat for sliding engagement. Liner 30 is a vacuum formed plastic part and for fabrication processing reasons, it may be preferable to have a slight draft between the front and back of ribs 40. Accordingly, although ribs 40 are substantially horizontal, guide channels 42 may be slightly narrower at back wall 32 than at the front. As shown, ribs 40 are tapered toward respective side panels 34 and 36 at the front 49.

Figure 3:
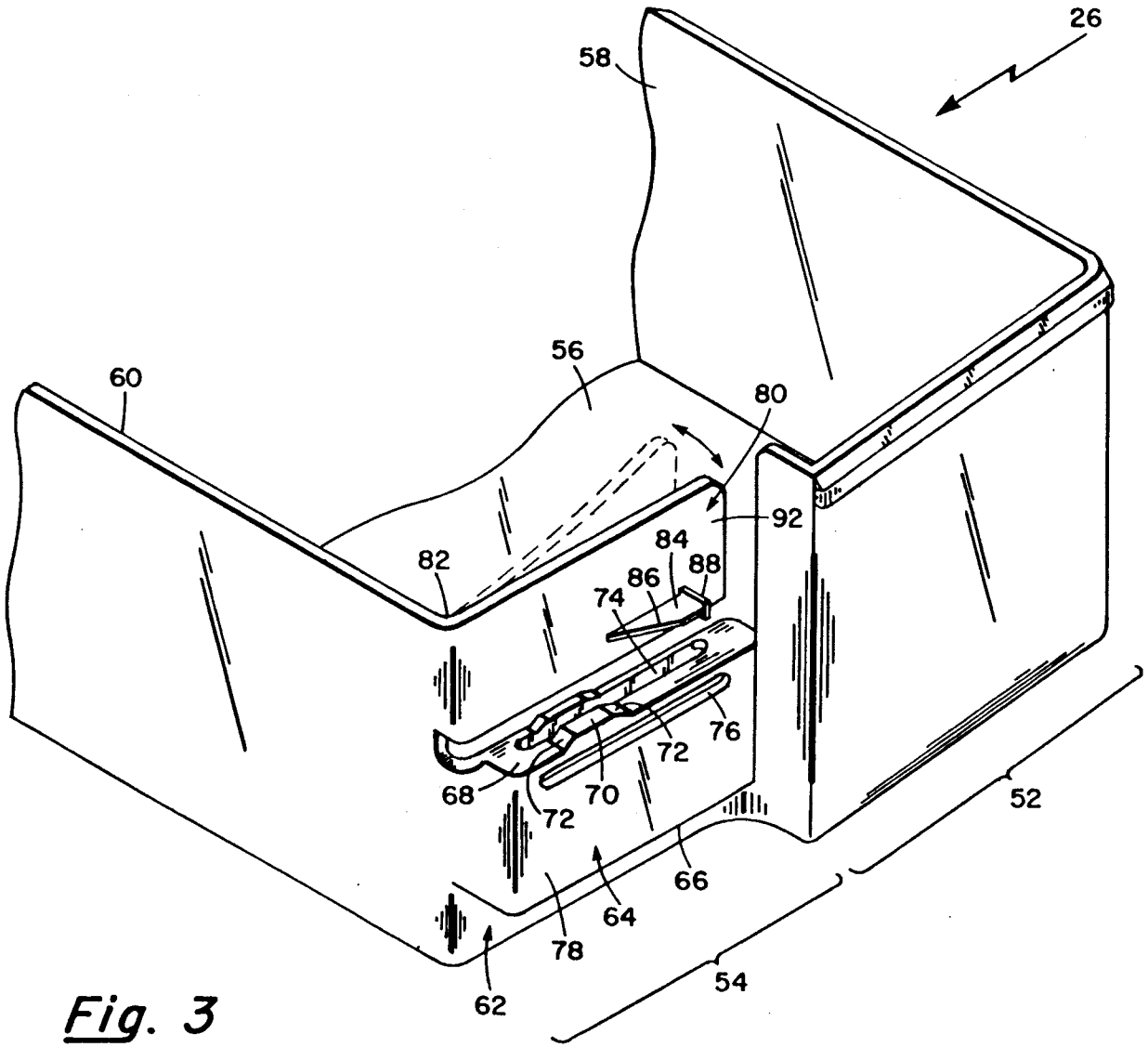
FIG. 3 is a side perspective view of one embodiment of a bucket shelf.
Figure 4:
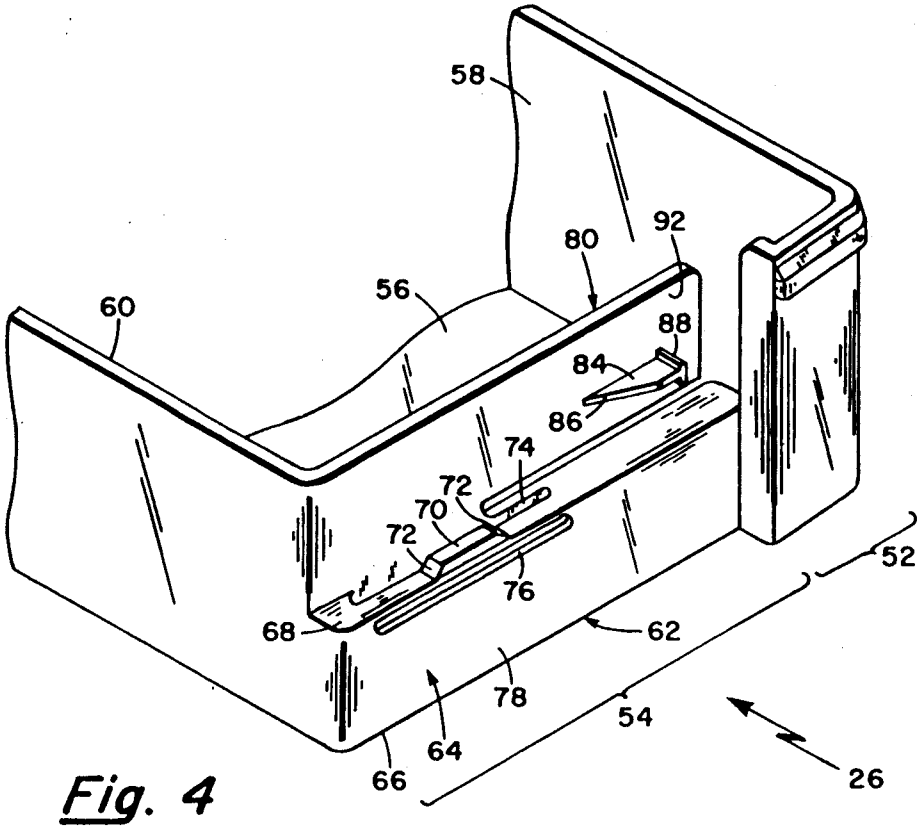
FIG. 4 is a side perspective view of an alternate embodiment of a bucket shelf.

Also referring to FIGS. 3 and 4, side perspective views of shelves 26 are shown. FIGS. 3 and 4 show alternate embodiments of shelves 26 that are configured for doors 24 and 22 that have different front to back depths, and generally are used for different storage requirements. For example, refrigerated food section doors 24 are typically wider than freezer doors 22, and it is also desirable that the shelves 26 in refrigerated food section doors 24 extend further out to the front from liner 30 so as to provide easier access for frequently accessed storage items such as milk cartons or bottled soft drinks. For these reasons, the embodiment of FIG. 3 with a relatively long front portion 52 and relatively short back portion 54 may be desirable for a refrigerated food section door 24, while the embodiment of FIG. 4 may be preferable for a freezer door 22. For example, the dimensions of a refrigerated food section door 24 may typically be 17" wide, 3.5" high, and 5.5" front-to-back depth with the front portion 52 and back portion 54 each being 2.75". The dimensions of a freezer section door 22 may typically be 11" wide, 2.5" high, and 5.5" front-to-back depth. As will become apparent, however, both shelves 26, as shown in the embodiments of FIGS. 3 and 4, attach to door liner 30 in the same general manner in accordance with the invention.

Although other types of shelves 26 could be used, here shelves 26 are shown to be bucket shelves each with a bottom wall 56, front and back walls 58 and 60, and ends 62. With the sealed arrangement of a bucket type shelf 26, spills are retained within the shelf 26 rather than dripping or running down to other parts of refrigerator 10.

Figure 5:
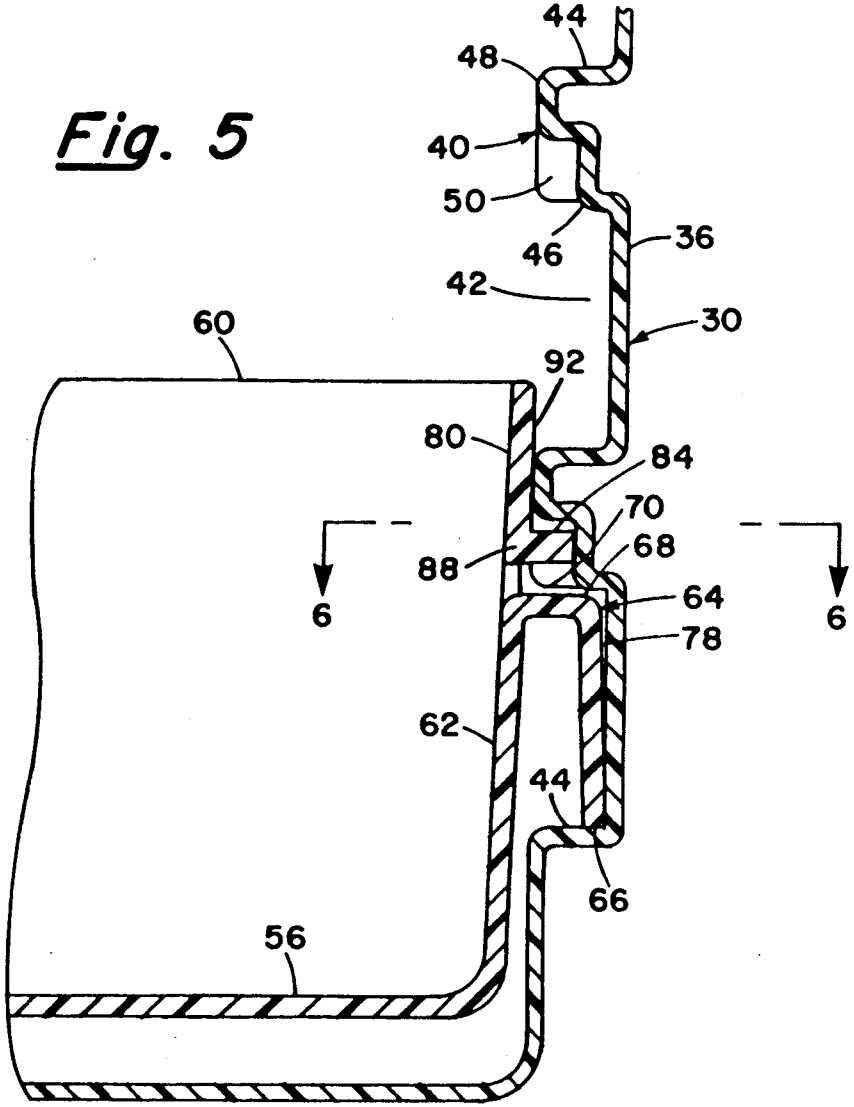
FIG. 5 is a front sectioned view of a bucket shelf mounted and latched in a track of the door liner.

Ends 62 include a runner 64 or rail that is generally a laterally extending front to back rectangular projection that has a height adapted to be received in sliding engagement in a guide channel 42. For example, guide channels 42 and runners 64 for a refrigerated food section door 24 may be 1.25" high with a front-to-back depth of 2" or more. Guide channels 42 and runners 64 for freezer doors 22 may be 1" high with a front-to-back depth of 4.5". Typically, shelf 26 is an injection molded plastic part, and it may be preferable to form runner 64 as a skirt with an open bottom as shown in FIG. 5. Runner 64 has a substantially horizontal bottom edge 66 or surface, and an upper surface 68. Upper surface 68 has an upwardly extending plateau 70 or boss with inclined surfaces 72 at the front and back. Typically, plateau 70 may have a height of approximately 1/16th of an inch. Slits 74 and 76 are respectively provided in upper surface 68 and side surface 78 so that the portion of upper surface 68 supporting plateau 70 may bend slightly downwardly when a downward force is exerted on plateau 70.

Detached from runner 64 is a side flap 80 that is resiliently connected to back 60 at corner 82 of the embodiment of FIG. 3, and to a portion of the end wall in FIG. 4. The plastic of shelf 26 is resilient such that a lateral force on the front of flap 80 causes flap 80 to flex or bend as shown by the dotted lines in FIG. 3; flap 80 of the embodiment of FIG. 4 bends similarly. A ramp tab 84 extends laterally from flap 80. That is, tab 84 has an inclined surface 86 down to the surface of flap 80.

Figure 6:
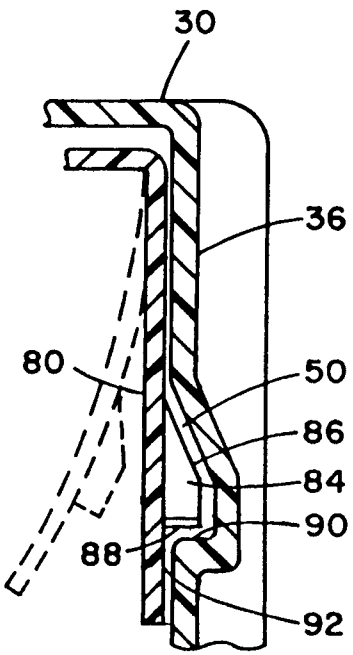
FIG. 6 is a view taken along line 6—6 of FIG. 5.

One of the features of shelf 26 is that it can be attached to door liner 30 at alternate vertical positions such that the user can reconfigure the arrangement of shelves 26 in door 22 or 24. More specifically, shelves 26 can be inserted in guide channels 42 of tracks 38 at different heights. In operation, the user selects the particular guide channel 42 for mounting a shelf 26, and inserts the left runner 64 in the guide channel 42 of the left side panel 34. The spacing between opposite runners 64 at the sides of shelf 26 is such that the opposite runner 64 aligns with the corresponding guide channel 42 of the opposite side panel 36. As shown in FIG. 5, the bottom edge 66 of runner 64 rests on the upper surface 44 of the lower rib 40. The shelf 26 is then pushed rearwardly as the runners 64 move in sliding engagement with respective guide channels 42. Flap 80 abuts the inward surface 48 of the upper rib 40. When the shelf 26 inserts to a position where the inclined surface 86 of ramp tab 84 contacts the tapered front 49 of upper rib 40, an inwardly lateral force is exerted on ramp tab 84 such that flap 80 bends inwardly. Flap 80 continues to be bent inwardly as shelf 26 is slid rearwardly until ramp tab 84 aligns with notch 50, at which point the resiliency of the bent plastic causes flap 80 to flex outwardly as ramp tab 84 enters notch 50 as shown in FIG. 6. Ramp tab 84 and notch 50 are aligned front to back such that this occurs at the fully inserted position of shelf 26. Thus, in this fully inserted position, withdrawal of shelf 18 is prevented by the front edge 88 of ramp tab 84 engaging the inward front surface 90 of notch 50.

The height of runner 64 with plateau 70 is preferably such that an interference fit is provided in guide channel 42, at least in the fully inserted position where the draft of ribs 40 may cause the height of guide channels 42 to be slightly less at the rear than at the front. Slits 74 and 76 on opposite sides of upper surface 68 in the region of plateau 70 enables plateau 70 to flex downwardly to accommodate an interference fit with some tolerance. Bottom edge 66 seats flushly on the upper surface 44 of the bottom rib 40, and, along with upper rib 40, movement of shelf 26 in the vertical direction is prevented. Accordingly, shelf 26 cannot be inadvertently knocked or bumped from its mounted attachment to liner 30. Also, the engagement of ramp tabs 84 into respective notches 50 at the sides securely engages shelf 26 in place so that it cannot be inadvertently slid out of respective support guide channels 42.

Figure 7:
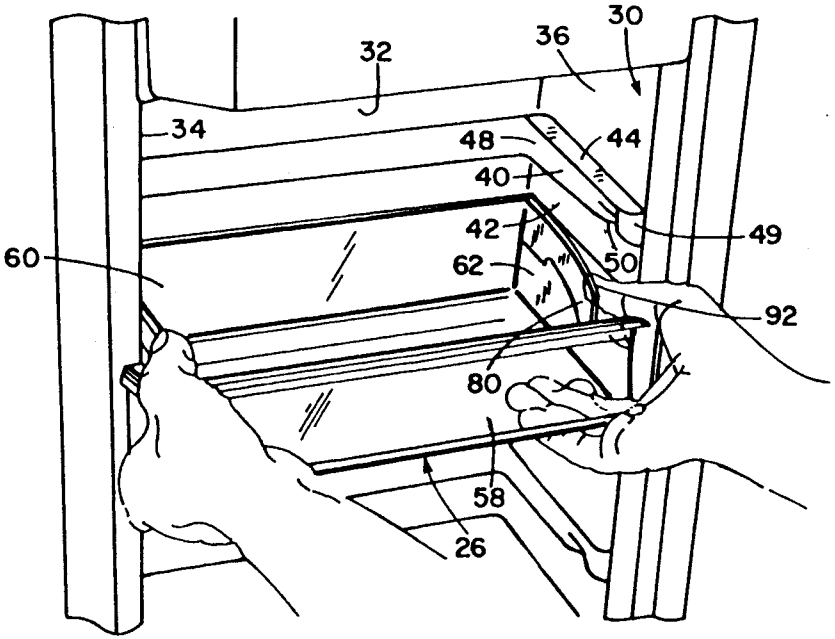
FIG. 7 is a view of a bucket shelf being removed from its mounted position within the door liner.

Shelf 26 can also easily and conveniently be removed from its attachment or liner 30 so as to be cleaned and replaced, or merely to change the height configuration of shelves. As shown best in FIG. 5, flap 80 extends up above the upper rib 40 when a shelf 26 is mounted in the fully inserted position. Thus, as shown in FIG. 7, the user can easily grasp the front portion 52 of the shelf 26 with fingers, and reach up and over front wall 58 with the thumbs to engage the outside surface 92 of respective flaps 80. In this position, the thumbs are positioned in the guide channel 42 above the guide channel 42 in which the shelf 26 is mounted. Then, by applying inward pressure with the thumbs, the flaps 80 are flexed or bent inwardly until respective ramp tabs 84 are withdrawn from respective notches 50 as shown in the dotted position in FIG. 6. In this configuration, the shelf 26 is no longer latched in the fully inserted position, and the user can easily and conveniently remove the shelf 26 forwardly with the runners 64 slidingly engaging respective guide channels 42. Once removed, it is apparent that the shelf can be remounted in the same or a different set of corresponding tracks 38.

In accordance with the invention, a liner 30 and shelf 26 arrangement is provided wherein the shelves 26 can easily and conveniently be mounted at a variety of alternate vertical positions so as to obtain a desired shelf configuration. Also, the runners 64 of a shelf 26 are held between upper and lower ribs 40 so that a shelf 26 cannot be inadvertently knock from its mounted position. Further, flap 80 and ramp tabs 84 in cooperation with notches 50 provide a latching arrangement which prevents inadvertent withdrawal of a shelf 26 from its fully inserted or mounted position. The weight load of the shelf 26 and its stored contents is also distributed over a relatively large surface area as defined by the contact area between runners 64 and ribs 40. Thus, a relatively rigid and firm shelf 26 can be provided without using unduly thick gauges of plastic for the injection molding. Furthermore, the arrangement of runners 64 enables mounting of shelf 26 without having a tight tolerance between side panels 34 and 36 or liner dikes.

This concludes the description of the preferred embodiments. However, a reading of this description will bring to mind many modifications and alterations without departing the spirit and scope of the invention. Accordingly, it is intended that the scope of the invention be limited only by the appended claims.

What is claimed is:

1. Refrigerator door apparatus comprising:

a door liner having opposing side panels each comprising at least a pair of substantially horizontal ribs forming therebetween a guide channel, said guide channels facing each other from said opposing side panels;

a shelf comprising substantially horizontal side runners each adapted for being received in sliding engagement into a respective one of said guide channels wherein said shelf is substantially horizontally slidable to an inward position in said guide channels where said shelf is supported by said liner;

said shelf further comprising means for latching said shelf to said liner when said shelf is positioned at said inward position; and at least one of said ribs having a notch and said latching means comprising a flexible finger with a tab wherein, as said shelf is being slideably inserted in said guide channels, said tab engages said one rib thereby bending said finger away from said rib until said tab aligns with said notch at which point said finer flexes back as said tab enters said notch to latch said shelf in said inward position.

2. The apparatus recited in claim 1 wherein said runners comprise means for providing an interference fit between said runners and said ribs.

3. The apparatus recited in claim 1 wherein said side panels each comprises more than a pair of said ribs forming a plurality of said guide channels wherein said shelf can be supported at alternate vertical positions.

4. Refrigerator door apparatus comprising:

a shelf having front and back rails of the lateral edges;

a door linear having opposing side panels comprising means for mounting said shelf at alternate vertical positions, said mounting means comprising a plurality of tracks each having a corresponding track on the opposing side panel, said tracks each comprising upper and lower substantially horizontal liner ribs forming therebetween a guide channel to receive a respective one of said shelf rails in sliding engagement wherein said shelf is mounted to said liner by sliding said rails inwardly in respective ones of said guide channels on opposing side panels to a mounted position;

means for latching said shelf to said linear at said mounted position; and at least one of said ribs has a notch, and said latching means comprises a flexible flap with a tab wherein sliding engagement of said tab against said one rib causes said flap to be bent away from said one rib until said tab aligns with said notch at which point said flap flexes back as said tab enters said notch to latch said shelf in said mounted position.

5. The apparatus recited in claim 4 wherein said rails each comprises a boss for providing an interference fit between said upper and lower ribs.

6. The apparatus recited in claim 4 wherein said flexible flap extends up above said upper rib to provide a surface for manually bending said flap inwardly to unlatch said shelf for removal.

7. Refrigerator door apparatus comprising:

a door linear having opposing side panels and a back panel, each of said side panels having a plurality of substantially horizontal ribs forming a plurality of like guide grooves between adjacent ones of said ribs, each of said guide grooves having a corresponding facing guide groove on the opposing one of said side panels, each of said ribs having an inward facing surface with a notch;

a bucket shelf having substantially horizontal front to back side runners each adapted to be received in sliding engagement in alternate ones of said plurality of guide grooves in one side panel while the opposite runner is received in the corresponding guide groove of the opposing side panel of said liner wherein said shelf can be inserted in corresponding guide grooves at alternate vertical levels; and said bucket shelf further comprising flexible side flaps each with an laterally extending tab wherein, as said runners are slid into corresponding grooves, each of said tabs slides along a respective one of said inward facing surfaces of said ribs thereby bending the respective flaps away from said ribs until said tabs reach said respective notches and said flaps flex back toward said ribs as said tabs enter said respective notches thereby latching said shelf bucket to said liner.

8. The apparatus recited in claim 7 wherein said runners each comprises a vertical boss to provide an interference fit within said guide grooves.

9. The method of attaching a shelf to a refrigerator door liner comprising the steps of:

providing a door linear having opposing side panels each having a plurality of horizontal ribs forming a plurality of substantially horizontal guide slots between adjacent ones of said ribs, each of said guide slots having a corresponding guide slot on the opposing one of said side panels, each of said ribs having a notch;

providing a shelf having horizontal runners at each lateral side, said runners being spaced to be received in corresponding guide slots on said opposing panels of said liner, said shelf having inwardly flexible side flaps each with an outwardly extending tab; and inserting said runners of said shelf into corresponding guide slots of a preselected vertical mounting position and pushing said runners into said slots wherein said tabs contact said respective ribs in sliding engagement to bend said side flaps away from said ribs until said tabs align with and enter said respective notches thereby latching said shelf to said liner to prevent withdrawal of said runners from said respective guide slots.

10. The method recited in claim 9 further comprising the step of manually flexing said flaps away from said ribs to enable removal of said shelf.

* * * * *